US010420971B2

(12) United States Patent
Casamento

(10) Patent No.: US 10,420,971 B2
(45) Date of Patent: Sep. 24, 2019

(54) FREQUENCY FIRE EXTINGUISHER

(71) Applicant: Michael Casamento, Woodland Hills, CA (US)

(72) Inventor: Michael Casamento, Woodland Hills, CA (US)

( * ) Notice: Subject to any disclaimer, the term of this patent is extended or adjusted under 35 U.S.C. 154(b) by 300 days.

(21) Appl. No.: 15/415,757

(22) Filed: Jan. 25, 2017

(65) Prior Publication Data

US 2017/0216646 A1 Aug. 3, 2017

Related U.S. Application Data

(60) Provisional application No. 62/285,012, filed on Feb. 1, 2016.

(51) Int. Cl.
*A62C 99/00* (2010.01)
*A62C 2/04* (2006.01)

(52) U.S. Cl.
CPC ..... *A62C 99/009* (2013.01); *A62C 2/04* (2013.01)

(58) Field of Classification Search
CPC ..... A62C 2/00; A62C 2/04; A62C 99/009
See application file for complete search history.

(56) References Cited

U.S. PATENT DOCUMENTS

2010/0059236 A1* 3/2010 Yee ..... A62C 99/009 169/46
2010/0203460 A1* 8/2010 Formigoni ..... F23C 99/003 431/8
2016/0030784 A1* 2/2016 Tsutaki ..... A62C 99/0045 169/61
2017/0259098 A1* 9/2017 Tran ..... A62C 99/009

* cited by examiner

*Primary Examiner* — Ryan A Reis
(74) *Attorney, Agent, or Firm* — Kelly & Kelley, LLP

(57) ABSTRACT

An electronic fire suppression method that transmits a frequency wave pattern of electromagnetic wave(s) having particular frequencies, powers and durations configured to separate and isolate components of combustion so as to suppress and extinguish the fire. A device for implementing this method of fire suppression includes a power supply and an electromagnetic wave transmitter. The electromagnetic wave transmitter is capable of transmitting frequency wave patterns having the defined frequencies, powers and durations. The device may also include one or more frequency receivers, analyzers, and controllers for detecting, analyzing, and targeting operating frequencies of a fire.

19 Claims, 6 Drawing Sheets

FREQUENCY FIRE EXTINGUISHER

RELATED APPLICATIONS

This application claims priority to U.S. Provisional Application Ser. No. 62/285,012, filed on Feb. 1, 2016.

BACKGROUND OF THE INVENTION

The present invention is directed to fire extinguishing technology. More particularly, the present invention is directed to fire extinguishing devices and methods that rely upon electromagnetic waves for fire suppression. Even more particularly, the present invention is directed to electronic fire suppression devices and methods that rely on patterns and durations of electromagnetic wave frequencies that are proven to suppress fires of all types.

Currently all available portable and non-portable fire extinguishers and fire suppression systems, as well as, fire trucks, boats, and aircraft use water and/or some type of chemicals (liquid, powder, foam, gas, etc.)—either separately or in combination—via an available delivery method to smother a fire with these materials with the intent to suppress or terminate the fire. All these methods require a relatively large (depending on the size of the fire) quantity of these external materials, which are often expensive to purchase and/or transport. In addition, some suppression materials only work on certain types of fires and/or create considerable additional damage when used.

Accordingly, there is a need for a fire extinguisher device and/or method that is capable of suppressing fires of all types without the need to purchase or transport large quantities of suppression materials. The present invention fulfills these needs and provides other related advantages.

SUMMARY OF THE INVENTION

The present invention is directed to an electronic fire extinguisher that uses no water or chemicals. In this context, "electronic" refers to the source of the fire suppression rather than the type of fires. The inventive electronic fire extinguisher is operable to suppress fires of all types, including wood, paper, electrical, chemical, etc.

The present invention uses electronic circuits to emit electromagnetic patterns and oscillations of frequencies that cause certain constituents, e.g., atom(s), element(s), molecule(s) etc., to be repelled from one another, so as to prevent interaction of these constituents thereby causing the fire to self-terminate. The present invention has many advantages over the prior art fire extinguishers, firefighting suppression equipment and similar technology that is used.

The present invention can be portable or stationary. It can be used to terminate a small fire, a house or structure fire, or even a major forest fire. It can eliminate the need for installation of fire sprinklers throughout structures and can even eliminate the need for fire trucks to transport their own water and chemicals to fires. It can even prevent the need to place fire hydrants on public and private streets. The improvements recognized by the present invention can save vast amounts of the world's natural resources.

The present invention is directed to a process for electronically suppressing combustion in a fire. The process includes the steps of providing an electromagnetic wave transmitter, directing a frequency wave pattern generated by the transmitter into the fire, and preventing interaction of combustion components in the fire. The frequency wave pattern has one or more electromagnetic waves, each having a frequency in the range of 2.5 Hz-128.0 GHz.

Each electromagnetic wave preferably has a power in the range of 0.1 W to 4.0 W. The frequency and power of each electromagnetic wave in the frequency wave pattern preferably have an inverse relationship. Each electromagnetic wave in the frequency wave pattern preferably has a duration in the range of 0.1 sec-10 sec, except for a final electromagnetic wave in the frequency wave pattern, which has a duration until the fire is extinguished.

The frequency of each electromagnetic wave in the frequency wave pattern has an ordered progression that is either ascending or descending relative to the other electromagnetic waves in the pattern. Preferably, each electromagnetic wave in the frequency wave pattern initiates a harmonic resonance with combustion components in the fire. The frequency wave pattern preferably also alters an operating frequency of the fire so as to establish a Natural Harmonic Frequency with the combustion components in the fire.

A particularly preferred frequency wave pattern consists of:

- a first electromagnetic wave having a frequency of 3.573 Hz at a power of 2.98 W and a duration of 2.83 sec;
- a second electromagnetic wave having a frequency of 17.632 Hz at a power of 2.75 W and a duration of 3.89 sec; and
- a third electromagnetic wave having a frequency of 45.895 Hz at a power of 2.57 W and a continuous duration until the fire is extinguished.

Another particularly preferred frequency wave pattern consists of:

- a first electromagnetic wave having a frequency of 4.689 Hz at a power of 2.89 W and a duration of 4.13 sec;
- a second electromagnetic wave having a frequency of 9.367 Hz at a power of 2.74 W and a duration of 5.12 sec; and
- a third electromagnetic wave having a frequency of 301.482 Hz at a power of 2.25 W and a continuous duration until the fire is extinguished.

Still another particularly preferred frequency wave pattern consists of:

- a first electromagnetic wave having a frequency of 104.794 KHz at a power of 2.77 W and a duration of 4.92 sec;
- a second electromagnetic wave having a frequency of 542.296 MHz at a power of 2.49 W and a duration of 5.79 sec; and
- a third electromagnetic wave having a frequency of 66.312 GHz at a power of 1.69 W and a continuous duration until the fire is extinguished.

Still another particularly preferred frequency wave pattern consists of:

- a first electromagnetic wave having a frequency of 5.135 Hz at a power of 2.99 W and a duration of 1.74 sec;
- a second electromagnetic wave having a frequency of 22.135 KHz at a power of 2.59 W and a duration of 2.69 sec;
- a third electromagnetic wave having a frequency of 29.51.3 MHz at a power of 2.29 W and a duration of 6.67 sec; and
- a fourth electromagnetic wave having a frequency of 243.543 MHz at a power of 2.11 W and a continuous duration until the fire is extinguished.

Still another particularly preferred frequency wave pattern consists of:

a first electromagnetic wave having a frequency of 17.374 Hz at a power of 2.94 W and a duration of 3.93 sec;

a second electromagnetic wave having a frequency of 2.831 KHz at a power of 2.95 W and a duration of 4.91 sec;

a third electromagnetic wave having a frequency of 14.821 GHz at a power of 1.53 W and a duration of 5.31 sec; and a fourth electromagnetic wave having a frequency of 127.341 GHz at a power of 0.70 W and a continuous duration until the fire is extinguished.

Yet another particularly preferred frequency wave pattern consists of:

a first electromagnetic wave having a frequency of 9.049 Hz at a power of 2.95 W and a duration of 3.46 sec;

a second electromagnetic wave having a frequency of 1.637 MHz at a power of 2.17 W and a duration of 4.39 sec;

a third electromagnetic wave having a frequency of 2.719 GHz at a power of 1.93 W and a duration of 4.89 sec;

a fourth electromagnetic wave having a frequency of 26.198 GHz at a power of 1.17 W and a duration of 5.56 sec; and a fifth electromagnetic wave having a frequency of 61.914 GHz at a power of 0.63 W and a continuous duration until the fire is extinguished.

A further particularly preferred frequency wave pattern consists of:

a first electromagnetic wave having a frequency of 259.726 KHz at a power of 2.91 W and a duration of 5.13 sec;

a second electromagnetic wave having a frequency of 803.673 KHz at a power of 2.71 W and a duration of 5.29 sec;

a third electromagnetic wave having a frequency of 26.486 MHz at a power of 1.97 W and a duration of 5.62 sec;

a fourth electromagnetic wave having a frequency of 1.851 GHz at a power of 1.38 W and a duration of 6.84 sec; and a fifth electromagnetic wave having a frequency of 29.936 GHz at a power of 0.95 W and a continuous duration until the fire is extinguished.

The present invention is also directed to an electronic fire suppression device to implement the above method. This device includes a power supply configured to have an alternating or direct voltage input between 3V-1000V, and an alternating or direct current input between 10 mA-1 kA, and an electromagnetic wave transmitter electrically connected to the power supply and configured to generate a frequency wave pattern of one or more electromagnetic waves, each having a frequency in the range of 2.5 Hz-128 GHz and a power in the range of 0.1 W-4.0 W. The device may further include an electromagnetic wave receiver electrically connected to the power supply and configured to detect an operating frequency of combustion components in a target portion of a fire, and a receiving frequency analyzer electrically connected to the frequency wave receiver and the frequency wave transmitter, wherein the receiving frequency analyzer is configured to analyze the operating frequency of combustion components in the target portion of the fire and cause the frequency wave pattern generated by the electromagnetic wave transmitter to establish a Natural Harmonic Frequency with the combustion components in the fire.

The electronic fire suppression device may also include a controller electrically connected to the electromagnetic wave transmitter and the receiving frequency analyzer, wherein the controller is configured to regulate the generation of the frequency wave pattern, including the frequency, power and duration of each of the one or more electromagnetic waves. A second receiving frequency analyzer may also be included, wherein the second receiving frequency analyzer is configured to analyze the effect of the frequency wave pattern on the combustion components in the fire so as to optimize the Natural Harmonic Frequency with the combustion components. Together with the second receiving frequency analyzer, a second electromagnetic wave receiver may be included. The second electromagnetic wave receiver is configured to detect the operating frequency of combustion components in a second portion of the fire.

A second controller may also be electrically connected to the electromagnetic wave transmitter and the second receiving frequency analyzer. The second controller is configured to program the electromagnetic wave transmitter to generate a second frequency wave pattern, including the frequency, power and duration of each electromagnetic wave when the fire suppression device is pointed at the target portion of the fire.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
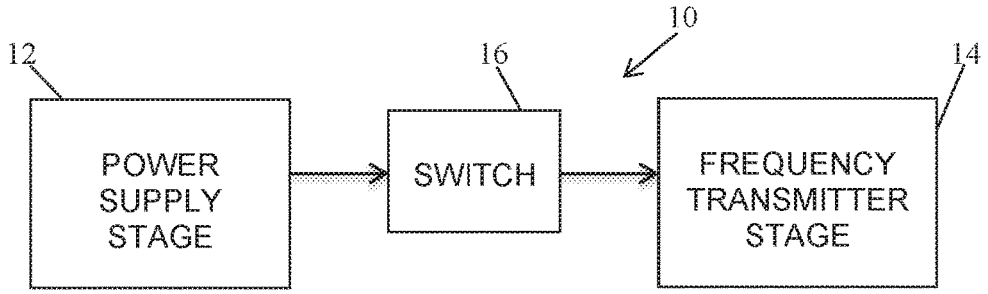
FIG. 1 is a functional block diagram of a preferred embodiment of the present invention showing a power supply stage and an electromagnetic wave transmitter stage.

In the following detailed description, the inventive electronic fire extinguisher present invention is generally referred to by reference numeral 10 in FIGS. 1-9. The primary components of the electronic fire extinguisher 10 are the power supply 12, and the frequency wave transmitter 14.

Referring now to the invention in more detail, the inventive electronic fire extinguisher 10 suppresses combustion and/or fires by emitting oscillating electromagnetic waves with fire-suppression dependent frequency, amplitude, modulation, bandwidth, and harmonics in a specific pattern. These specific patterns promote fire suppression by separating, isolating, and excluding components of combustion, e.g., specific atom(s), element(s), molecule(s), compound(s), etc., to be temporarily moved away from one another, thereby disrupting the interactions between these components necessary for combustion to continue, thereby removing the ability of the combustion or fire to sustain itself.

It is important to note that the electromagnetic waves discussed herein are distinguished from waves that are mechanical in nature. Such mechanical waves (e.g., sound, surf, etc.) typically require some sort of medium (e.g., air, water, etc.) in which to travel and cause some form is displacement within the medium. In contrast, electromagnetic waves require no medium in which to travel. The following detailed description is directed to the use of electromagnetic waves as the source of fire suppression.

As used herein, the term "combustion components" is intended to refer to those atoms, elements, molecules, compounds, etc., that are considered necessary to combustion. It is commonly accepted that a fire requires three things: fuel, heat, and air. This is a very simplistic view of the components, particularly where air is considered primarily for the Oxygen it contains. In fact, air contains many more components that participate in combustion, including, but not limited to, Oxygen, Carbon, Nitrogen, and Hydrogen, as well as molecules that have components made up of the same common elements. Most of these components of air promote combustion in some manner.

While the frequency wave patterns disrupt interactions between these combustion components, the continued frequency wave patterns also prevent these combustion components from moving back together so as to re-kindle the fire as long as the oscillating frequencies are being emitted into the fire. Once the fire is extinguished, the frequency wave patterns can be stopped because the fire has no ignition source to reignite. After the frequency wave pattern is ceased, all of the components are allowed to re-occupy whatever space is available without concern about further combustion.

The oscillating frequencies and their harmonics emitted by this invention are capable of separating nearly all of the components that are commonly found in the atmosphere, including Oxygen, Carbon, Nitrogen, and Hydrogen, as well as molecules that have components made up of the same elements. These are some of the basic components necessary for combustion and separation of one or more of these components inhibits combustion.

There are a great many frequency wave patterns that can be used for combustion/fire suppression, as long as the correct associated attributes of frequency, power and duration are configured for the specific pattern. The large number of available frequency wave patterns is possible because the following mechanisms can trigger each other multiple times. These mechanisms are:

- The frequency wave pattern makes up a repulsion beam that certain particles, ions, atoms, elements, molecules, and compounds cannot cross;
- The frequency wave patterns prevent the interaction of particular types of particles, ions, atoms, elements, molecules, and compounds that are necessary to sustain combustion/fire;
- The frequency wave patterns initiate harmonic resonance frequencies that cause certain particles, ions, atoms, elements, molecules, and compounds in the fire to disperse or erupt out of the combustion/fire;
- The frequency wave patterns interact with "operating frequencies" of combustion/fire, thereby disrupting and changing the "operating frequencies" of the combustion/fire;
- The frequency wave patterns cause the combustion/fire to reach its Natural Harmonic Frequency where particles, ions, atoms, elements, molecules, and compounds in the combustion/fire oscillate until they are unable to interact and continue the process of combustion.

A frequency wave pattern may consist of a single electromagnetic wave or multiple electromagnetic waves. The overall range of frequencies for all frequency wave patterns is between 2.500 Hertz (Hz) and 128.000 Gigahertz (GHz). As discussed above, the electronic fire extinguisher does not rely upon sound waves, acoustic waves, or other waves that require a medium or generate physical movement of that medium. Some prior art device rely upon such sound or acoustic waves passing through air in an attempt "blow-out" a fire. As discussed herein, the electronic fire extinguisher relies upon oscillations of the electromagnetic waves to interact with the combustion components and prevent interaction of the same.

The overall range of power for electromagnetic waves is 0.1 Watts(W) to 4.00 W. The overall range of duration of electromagnetic waves is generally between 0.1 seconds and 10 seconds, except for the final electromagnetic wave in a frequency wave pattern which is effectively continuous until the combustion/fire is extinguished. General guidelines for frequency wave pattern requirements include that the starting electromagnetic wave in a pattern has a duration of between 0.1 seconds and 10 seconds, unless the pattern consist of a single electromagnetic wave, in which case the single electromagnetic wave will be maintained until the fire is extinguished. In addition, higher frequencies in a frequency wave pattern require that a particular electromagnetic wave be maintained for a longer duration versus an electromagnetic wave having a lower frequency in the context of operability for fire suppression.

In addition, the power output for any particular electromagnetic wave needs to be between 0.01 W and 4.0 W for distances of up to 1,000 feet from the frequency wave transmitter. Frequency and power have an inverse relationship, e.g., lower frequencies require more power than higher frequencies, as far as operability for fire suppression is concerned. A larger power output may be needed for distances greater than 1,000 feet. When utilizing proper frequency, power, and duration characteristics, there is effectively no minimum or maximum distance from a fire at which the present invention will operate. With sufficiently large transmission frequency wattages, the present invention can operate at distances of up the five miles or more. Such would be beneficial for devices mounted on aircraft or other similar mobile vehicles for use with forest fires. However, a person of ordinary skill in the art will appreciate that as distance from a fire increases, the possibility of obstruction of interference with the frequency wave pattern increases.

Preferably, the frequencies of electromagnetic waves in a frequency wave pattern are either in ascending or descending order. It has been observed that a progression of frequencies in a frequency wave pattern is more likely to produce the desired harmonic oscillation of combustion components versus patterns that contain both increases and decreases in frequency progression.

Some particularly preferred frequency wave patterns for fire suppression are as follows:

Pattern 1

| Frequency | Duration | Power | Wavelength | Designation |
|---|---|---|---|---|
| 3.573 Hz | 2.83 sec | 2.98 Watts | $10^5$ to $10^4$ Km | ELF |
| 17.632 Hz | 3.89 sec | 2.75 Watts | $10^5$ to $10^4$ Km | ELF |
| 45.895 Hz | Continuous | 2.57 Watts | $10^4$ to $10^3$ Km | SLF |

Pattern 2

| Frequency | Duration | Power | Wavelength | Designation |
|---|---|---|---|---|
| 4.689 Hz | 4.13 sec | 2.89 Watts | $10^5$ to $10^4$ Km | ELF |
| 9.367 Hz | 5.12 sec | 2.74 Watts | $10^5$ to $10^4$ Km | ELF |
| 301.482 Hz | Continuous | 2.25 Watts | $10^3$ to 100 Km | ULF |

Pattern 3

| Frequency | Duration | Power | Wavelength | Designation |
|---|---|---|---|---|
| 104.794 KHz | 4.92 sec | 2.77 Watts | 10 to 1 Km | LF |
| 542.296 MHz | 5.79 sec | 2.49 Watts | 1 m to 10 cm | UHF |
| 66.312 GHz | Continuous | 1.69 Watts | 1 cm to 1 mm | EHF |

Pattern 4

| Frequency | Duration | Power | Wavelength | Designation |
|---|---|---|---|---|
| 5.135 Hz | 1.74 sec | 2.99 Watts | $10^5$ to $10^4$ Km | ELF |
| 22.135 KHz | 2.69 sec | 2.59 Watts | 100 to 10 Km | VLF |
| 29.513 MHz | 6.67 sec | 2.29 Watts | 100 to 10 m | HF |
| 243.543 MHz | Continuous | 2.11 Watts | 10 to 1 m | VHF |

Pattern 5

| Frequency | Duration | Power | Wavelength | Designation |
|---|---|---|---|---|
| 17.374 Hz | 3.93 sec | 2.94 Watts | $10^5$ to $10^4$ Km | ELF |
| 2.831 KHz | 4.91 sec | 2.95 Watts | 1 m to 10 cm | UHF |
| 14.821 GHz | 5.31 sec | 1.53 Watts | 1 cm to 1 mm | EHF |
| 127.341 GHz | Continuous | 0.70 Watts | 1 mm to 0.1 mm | THF |

Pattern 6

| Frequency | Duration | Power | Wavelength | Designation |
|---|---|---|---|---|
| 9.049 Hz | 3.46 sec | 2.95 Watts | $10^5$ to $10^4$ Km | ELF |
| 1.637 MHz | 4.39 sec | 2.17 Watts | 1 Km to 100 m | MF |
| 2.719 GHz | 4.89 sec | 1.93 Watts | 1 m to 10 cm | UHF |
| 26.198 GHz | 5.56 sec | 1.17 Watts | $10^4$ to $10^3$ Km | SHF |
| 61.914 GHz | Continuous | 0.63 Watts | 1 cm to 1 mm | EHF |

Pattern 7

| Frequency | Duration | Power | Wavelength | Designation |
|---|---|---|---|---|
| 259.726 KHz | 5.13 sec | 2.91 Watts | 10 to 1 Km | LF |
| 803.673 KHz | 5.29 sec | 2.71 Watts | 1 Km to 100 m | MF |
| 26.486 MHz | 5.62 sec | 1.97 Watts | 100 to 10 m | HF |
| 1.851 GHz | 6.84 sec | 1.38 Watts | 1 m to 10 cm | UHF |
| 29.936 GHz | Continuous | 0.95 Watts | 1 cm to 1 mm | EHF |

The designation of frequencies and wavelengths is as follows:

| Frequency | Wavelength | Designation | Abbrev |
|---|---|---|---|
| 3 to 30 Hz | $10^5$ to $10^4$ Km | Extremely low frequency | ELF |
| 30 to 300 Hz | $10^4$ to $10^3$ Km | Super low frequency | SLF |
| 300 to 3000 Hz | $10^3$ to 100 Km | Ultra-low frequency | ULF |
| 3 to 30 KHz | 100-10 Km | Very low frequency | VLF |
| 30 to 300 KHz | 10-1 Km | Low frequency | LF |
| 300 KHz to 3 MHz | 1 Km to 100 m | Medium Frequency | MF |
| 3 to 30 MHz | 100-10 m | High frequency | HF |
| 30 to 300 MHz | 10-1 m | Very high frequency | VHF |
| 300 MHz to 3 GHz | 1 m-10 cm | Ultra-high frequency | UHF |
| 3 to 30 GHz | 10-1 cm | Super high frequency | SHF |
| 30 to 300 GHz | 1 cm-1 mm | Extremely high frequency | EHF |
| 300 GHz to 3 THz | 1-0.1 mm | Tremendously high frequency | THF |

The present invention is used by aiming a device 10 configured to emit the inventive frequency wave patterns directly at a point in a fire. As the frequency wave patterns emitted by the device affect the components of the fire, the fire will begin to degrade until the point at which it is extinguished. At this point, the device is then aimed at another section of the fire until that section is extinguished. This process is continued until the entire fire is extinguished. For larger fires (i.e. forest fires) the device may be attached to a vehicle (i.e. aircraft, plane, helicopter, boat, car, truck, etc.) and is controlled by wired or wireless remote inside the vehicle. The process of use is similar.

As shown in FIG. 1, the most basic embodiment of the electronic fire extinguisher 10 consists of a power supply stage 12 and a frequency transmitter stage 14. The power supply stage 12 is electrically connected to the frequency transmitter stage 14 so as to be able to receive, use, or transfer the necessary voltage and current to or from the frequency transmitter stage 14. The power supply stage 12 can also receive, use, or transfer data, communication, and control information to the frequency transmitter stage 14.

The power supply stage 12 may have a wide range of input voltages. In one embodiment, the power supply stage 12 preferably has a voltage input ranging from 3 volts alternating current (VAC) to 1000 VAC with a current rating from 100 milliamp hours (mAh) to 1000 amp hours (Ah). Such alternating current input voltage preferably has a frequency of 50 hertz or 60 Hertz. Alternatively, the power supply stage 12 can have an input ranging from 3 volts direct current (VDC) to 1000 VDC with a current rating from 100 mAh to 1000 Ah. The voltage and current output of the power supply stage 12 can range from 3 VAC to 1000 VAC with a current output of 100 ma to 1 kA (depending on input voltage and current) or/and 3 VDC to 1000 VDC with a current output of 100 ma to 1 kA (also depending on input voltage and current).

The power supply stage 12 can include but is not limited to the following types of input/output hardware connections for interfacing with other devices: alternating current types: B, BS, C, D, E, F, H, J, K, L, I, N, M, or direct current types: Anderson, Aispss, Amp, barrel, cigar lighter socket/plug, Clipsal, concentric barrel, Deans, Din, Duac, EIAJ, inverter tabs/lugs, ISO 4165, JSBP, JST RCY, Kycon, MagSafe, MC4, Mini Din, Molex, Molex MicroFit, Molex Sabre, Molex SR, Power Pack, SR, Tip, Self, XLR, or USB. The direct current battery types that can be used with the power supply stage 12 include but are not limited to Alkaline, Nickel Cadmium (NiCD), Nickel Metal Hydride (NiMh), NiZN, Lithium, Lithium Ion, Lead Acid, Wet/flooded Type, Calcium-Calcium, VRLA (AGM, Gel), Deep Cycle, Cobalt Dioxide, NCM, NCA, and FePO.

The power supply stage 12 can include but is not limited to a wide variety of electronic components necessary to implement this stage, such as resistors, capacitors, diodes, Zener diodes, transistors (all family's and types), integrated circuits (i.e. CMOS, TTL, Logic, All Family types, etc.), LED's, voltage regulators, crystals, microprocessors, memory IC's (i.e. Ram, Rom Dram, Drom, SDRam, etc.), Zener diodes, etc. and an assortment of other various electronic components as needed. A person of ordinary skill in the art will appreciate the components necessary to build a necessary power supply.

The frequency transmitter stage 14 can output frequencies, harmonics and their related oscillations ranging from 1 Hertz to 128 gigahertz with power levels ranging from 0.1 W to 1 MW depending on the input voltage and current source. The output ranges of frequency and power (particularly power) of the frequency transmitter stage 14 are greater than the preferred ranges stated elsewhere. The preferred ranges stated elsewhere are intended as optimal ranges for the described distances and fires. Power outputs much greater than those preferred ranges would be necessary for fires at greater distances, e.g., greater than one thousand feet. For example, fires at ranges of up to five miles may be suppressed using power outputs in the range of about 50,000 W. As described more fully below, specific frequency and power ranges, along with corresponding durations, have particular benefit to the present invention. The output frequencies, harmonics, and their related oscillations can have a Root Mean Square (RMS) value that ranges from 1 volt to 1 Kv depending on input voltages and current source.

As mentioned above, the frequency transmitter stage 14 is electronically connected to the power supply stage 12 so as to receive, use, or transfer the necessary power to or from the power supply stage 12. The frequency transmitter stage 14 can also receive, use, or transfer data, communication, and control information to or from the power supply stage 12. The frequency transmitter stage 14 can include a wide variety of electronic components necessary to implement this stage, as understood by a person of ordinary skill in the art, such as resistors, capacitors, diodes, Zener diodes, transistors (all family's and types), integrated circuits (i.e. CMOS, TTL, Logic, All Family types, etc.), LED's, voltage regulators, crystals, microprocessors, memory IC's (i.e. Ram, Rom Dram, Drom, SDRam, etc.), Zener diodes, etc. and an assortment of other various electronic components as needed.

The electronic fire extinguisher 10 preferably contains an on/off mechanism 16, either electrical or mechanical in nature, for either switching off the power supply stage 12 or stopping the frequency transmitter stage 14 from emitting the electromagnetic waves. This mechanism 16 can be a slide switch, a push switch, a touch switch, a voice or sound activated switch, or any other kind of switch that selectively allows power to pass through. While FIG. 1 shows the mechanism 16 in the connection between the power supply stage 12 and the frequency transmitter stage 14, the mechanism 16 can be electrically connected to either stage 12, 14, or the connection in between.

Figure 2:
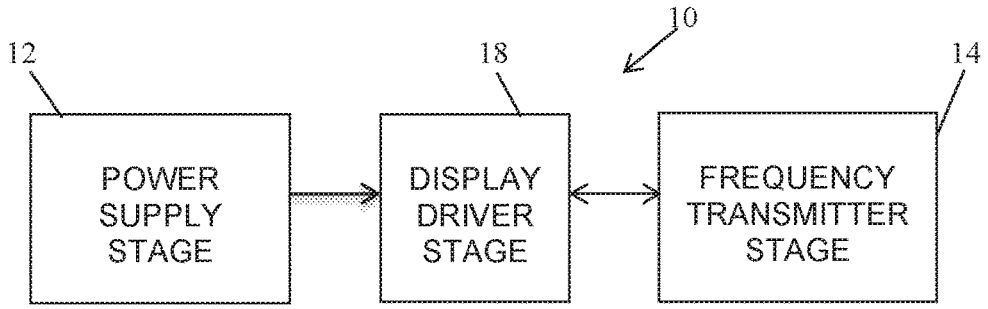
FIG. 2 is a functional block diagram of another preferred embodiment of the present invention showing the power supply stage, the electromagnetic wave transmitter stage, and a display driver stage.

As shown in FIG. 2, a second preferred embodiment of the electronic fire extinguisher 10 consists of the same power supply stage 12, frequency transmitter stage 14, and on/off mechanism 16 (not shown in FIG. 2) along with a display driver stage 18. The power supply stage 12, frequency transmitter stage 14, and on/off mechanism 16 are as described above. The display driver stage 18 is preferably electrically connected to the other stages 12, 14. FIG. 2 shows the display driver stage 18 between the power supply stage 12 and the frequency transmitter stage 14, but the parts may be assembled in any order.

As with the other stages, the display driver stage 18 can use, receive, or transfer power, data, communication and control information to or from the power supply stage 12 and/or the frequency transmitter stage 14. The display driver stage 18 is preferably configured to interact with the other stages 12, 14, so it preferably has similar ranges of input voltages and output signals.

The power supply stage 12, frequency transmitter stage 14, and/or display driver stage 18 can allow power, data, communication, and control information to be to input to or output from the electronic fire extinguisher 10. In the case of output, the power, data, communication, and control information may be exported to an external device (not shown) so as to allow the present invention to supply the necessary and voltage and current to power the connected external device.

The stages 12, 14, 18 may include interfacing with all common communication protocols, including but not limited to: Address Resolution Protocol (ARP), Dynamic Host Configuration Protocol (DHCP), Domain Name System), File Transfer Protocol FTP), Hypertext Transfer Protocol (HTTP), Hypertext Transfer Protocol Secure (HTTPS), Internet Control Message Protocol (ICMP), Internet Group Message Protocol (ICMP), Internet Group Management Protocol (IGMP), Internet Message Access Protocol version 4 (IMAP4), Network Time Protocol (NTP), Post Office Protocol version 3 (POP3), Real-Time Transport Protocol (RTP)—Voice over Internet Protocol (VOIP), Session Initiation Protocol (SIP)—Voice over Internet Protocol (VOIP), Simple Mail Transfer Protocol (STMP), Simple Network Management Protocol version 2 or 3 (SNMP2/3), Secure Shell, (SSH), Transmission Control Protocol/Internet Protocol (TCP/IP), Telnet, Trivial File Transfer Protocol (TFTP), Transport Layer Security (TLS), Datagram Protocol (UDP) and WIFI Protocols 802.11-1997, 802.11a(OFDM waveform), 802.11a, 802.11b, 802.11c, 802.11g, 802.11-2007, 802.11n, 802.11-2012, 802.11ac, 802.11ad, 802.11af, 802.11ah, 802.11ai, 802.11aj, 802.11aq, 802.11ax, and 802.11ay.

The display driver stage 18 can implement a visual display of information through a variety of different visual displays including but not limited to liquid crystal displays (LCD's), light emitting displays (LED's), fluorescent, and plasma displays with any colors of text and any colors of images and any colors of backgrounds. The purpose of the display driver stage 18 is to provide a user with a visual account of the performance, transmissions, current status and currently performing actions or processes of the electronic fire extinguisher 10. The display driver stage 18 may show electronic frequencies and/or frequency patterns being transmitted by the device 10.

The display driver stage 18 may include a wide variety of electronic components necessary to implement the functions of a visual display, including but not limited to resistors, capacitors, diodes, integrated circuits (i.e. CMOS, TTL, Logic, All Family types, etc.), LED's, voltage regulators, crystals, microprocessors, memory IC's (i.e. Ram, Rom Dram, Drom, SDRam) etc. and an assortment of other various components as needed, as well as a variety of different visual displays including but not limited to liquid crystal displays (LCD's), light emitting displays (LED's), fluorescent, and plasma displays.

Figure 3:
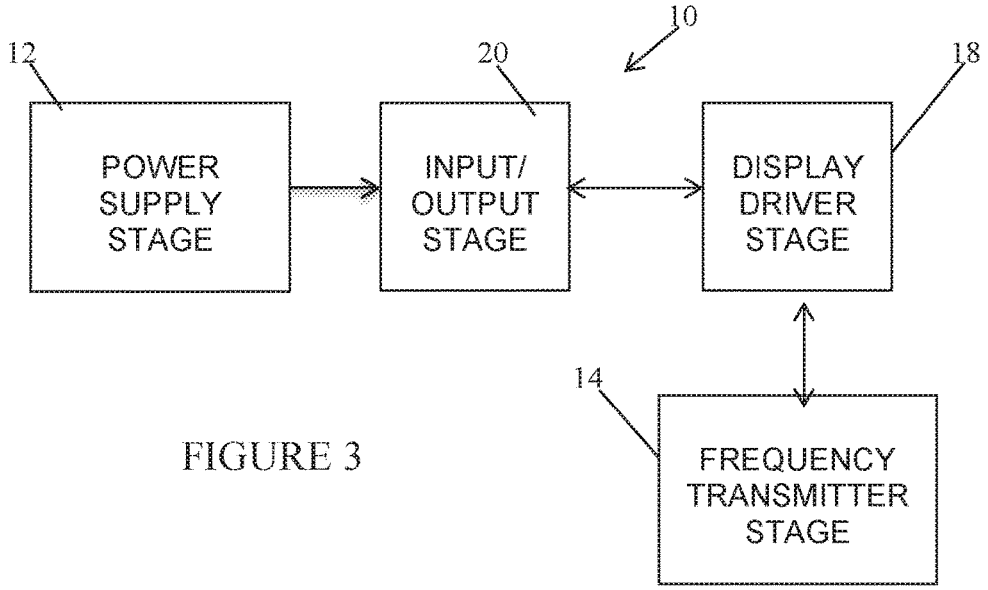
FIG. 3 is a functional block diagram of yet another preferred embodiment of the present invention showing the power supply stage, the electromagnetic wave transmitter stage, the display driver stage, and an input/output stage.

As shown in FIG. 3, a third preferred embodiment of the electronic fire extinguisher 10 consists of the same power supply stage 12, frequency transmitter stage 14, on/off mechanism 16 (not shown), and display driver stage 18, along with an input/output stage 20. The power supply stage 12, frequency transmitter stage 14, on/off mechanism 16, and display driver stage 18 are as described above. The input/output stage 20 is preferably electrically connected to the other stages 12, 14, 18. FIG. 3 shows the input/output stage 20 between the power supply stage 12 and the display driver stage 18, but the parts may be assembled in any order.

As with the other stages, the input/output stage 20 can use, receive, or transfer power, data, communication and control information to or from the power supply stage 12, the frequency transmitter stage 14, and/or the display driver stage 18. The input/output stage 20 is preferably configured to interact with the other stages 12, 14, 18, so it preferably has similar ranges of input voltages and output signals.

The input/output stage 20 facilitates the input or output of power, data, communication, and control information from the power supply stage 12, frequency transmitter stage 14, and/or display driver stage 18 in the electronic fire extinguisher 10. In the case of output, the power, data, communication, and control information may be exported to an external device (not shown) so as to allow the present invention to supply the necessary and voltage and current to power the connected external device.

As with the other stages, the input/output stage 20 may include but is not limited to the following types of input/output hardware connections: input/output jacks/plugs/ports for interfacing with other devices, alternating current types B, BS, C, D, E, F, H, J, K, L, I, N, M and direct current types Anderson, Aispss, Amp, barrel, cigar lighter socket/plug, Clipsal, concentric barrel, Deans, Din, Duac, EIAJ, inverter tabs/lugs, ISO 4165, JSBP, JST RCY, Kycon, MagSafe, MC4, Mini Din, Molex, Molex MicroFit, Molex Sabre, Molex SR, Power Pack, SR, Tip, Self, XLR, USB.

The input/output stage 20 can allow power, data, communication, and control information to be to input to or output from the electronic fire extinguisher 10 as described above. The input/output stage 20 can utilize common communication protocols including but not limited to: Address Resolution Protocol (ARP), Dynamic Host Configuration Protocol (DHCP), Domain Name System, File Transfer Protocol FTP), Hypertext Transfer Protocol (HTTP), Hypertext Transfer Protocol Secure (HTTPS), Internet Control Message Protocol (ICMP), Internet Group Message Protocol (ICMP), Internet Group Management Protocol (IGMP), Internet Message Access Protocol version 4 (IMAP4), Network Time Protocol (NTP), Post Office Protocol version 3 (POP3), Real-Time Transport Protocol (RTP)—Voice over Internet Protocol (VOIP), Session Initiation Protocol (SIP)—Voice over Internet Protocol (VOIP), Simple Mail Transfer Protocol (STMP), Simple Network Management Protocol version 2 or 3 (SNMP2/3), Secure Shell, (SSH), Transmission Control Protocol/Internet Protocol (TCP/IP), Telnet, Trivial File Transfer Protocol (TFTP), Transport Layer Security (TLS), Datagram Protocol (UDP) and WIFI Protocols 802.11-1997, 802.11a (OFDM waveform), 802.11a, 802.11b, 802.11c, 802.11g, 802.11-2007, 802.11n, 802.11-2012, 802.11ac, 802.11ad, 802.11af, 802.11ah, 802.11ai, 802.11aj, 802.11aq, 802.11ax, and 802.11ay.

The input/output stage 20 can include a variety of electronic components necessary to implement the electronic fire extinguisher 10 including the same components as described above.

Figure 4:
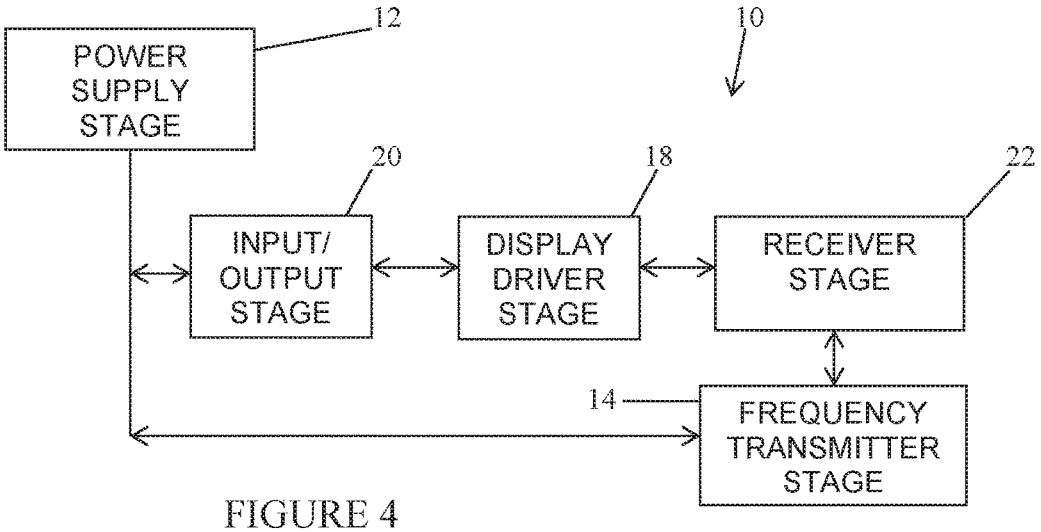
FIG. 4 is a functional block diagram of yet another preferred embodiment of the present invention showing the power supply stage, the electromagnetic wave transmitter stage, the display driver stage, the input/output stage, and a receiver stage.

As shown in FIG. 4, a fourth preferred embodiment of the electronic fire extinguisher 10 consists of the same power supply stage 12, frequency transmitter stage 14, on/off mechanism 16 (not shown), display driver stage 18, an input/output stage 20, as well as, a receiver stage 22. The power supply stage 12, frequency transmitter stage 14, on/off mechanism 16, display driver stage 18, and input/output stage 20 are as described above. The receiver stage 20 is preferably electrically connected to the other stages 12, 14, 18, 20. FIG. 4 shows the receiver stage 22 between the frequency transmitter stage 14 and the display driver stage 18, but the parts may be assembled in any order.

As with the other stages, the receiver stage 22 can use, receive, or transfer power, data, communication and control information to or from the power supply stage 12, the frequency transmitter stage 14, and/or the display driver stage 18. The receiver stage 22 is preferably configured to interact with the other stages 12, 14, 18, 20, so it preferably has similar ranges of input voltages and output signals.

The receiver stage 22 is configured to receive signals or frequencies generated by the fire to be analyzed by the present invention. Receiving frequencies in the receiver stage 22 will aid the electronic fire extinguisher 10 in determining what frequencies and/or patterns will have to be generated to disrupt the fire's ability to sustain itself.

Figure 5:
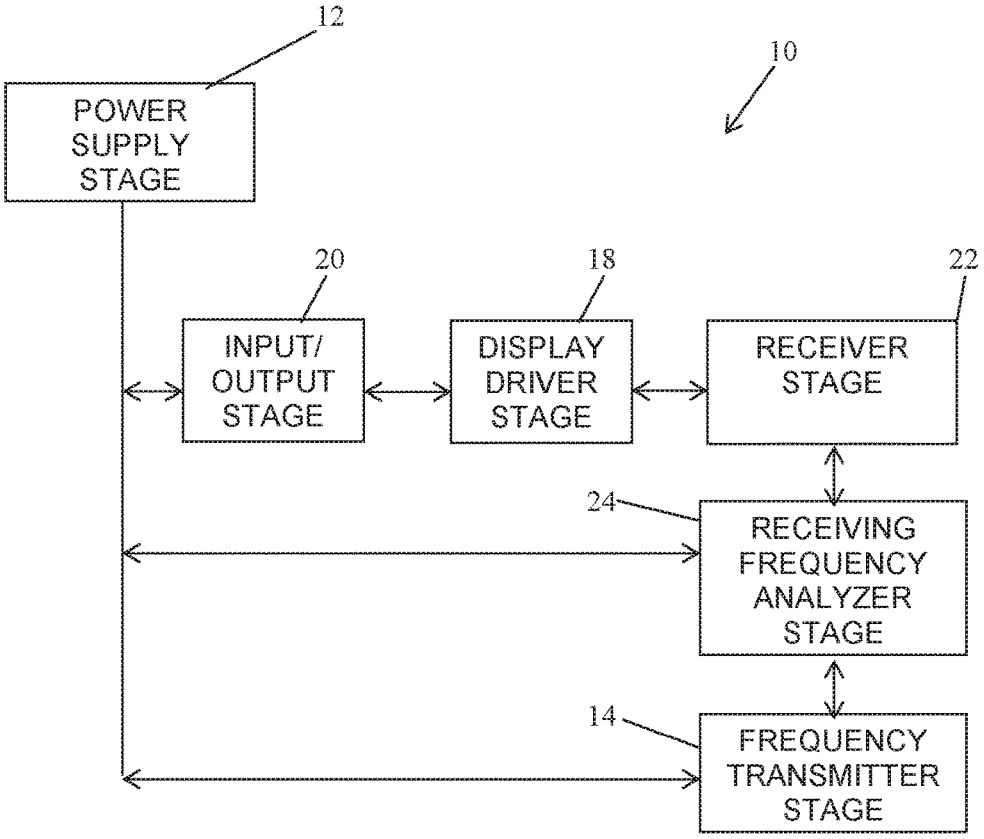
FIG. 5 is a functional block diagram of yet another preferred embodiment of the present invention showing the power supply stage, the electromagnetic wave transmitter stage, the display driver stage, the input/output stage, the receiver stage; and a receiving frequency analyzer stage.

As shown in FIG. 5, a fifth preferred embodiment of the electronic fire extinguisher 10 consists of the same power supply stage 12, frequency transmitter stage 14, on/off mechanism 16 (not shown), display driver stage 18, input/output stage 20, and receiver stage 22, as well as, a receiving frequency analyzer stage 24. The power supply stage 12, frequency transmitter stage 14, on/off mechanism 16, display driver stage 18, input/output stage 20, and receiver stage 22 are as described above. The receiving frequency analyzer stage 24 is preferably electrically connected to the other stages 12, 14, 18, 20, 22. FIG. 5 shows the receiving frequency analyzer stage 24 between the frequency transmitter stage 14 and the receiver stage 22 (or in parallel the power supply stage 12), but the parts may be assembled in any order.

As with the other stages, the receiving frequency analyzer stage 24 can use, receive, or transfer power, data, communication and control information to or from the power supply stage 12, the frequency transmitter stage 14, the display driver stage 18, the input/output stage 20, and/or the receiver stage 22. The receiving frequency analyzer stage 24 is preferably configured to interact with the other stages 12, 14, 18, 20, 22, so it preferably has similar ranges of input voltages and output signals.

The receiving frequency analyzer stage 24 works in conjunction with the receiver stage 22 to receive signals or frequencies generated by the fire to be analyzed as described above. The receiving frequency analyzer stage 24 can analyze the signals and frequencies received by the receiver stage 22 to determine the optimal transmitting frequencies to prevent the fire from sustaining itself. This analyzing process can involve but is not limited to the use of: software; software subroutines; quantum mechanics; nuclear physics; molecular chemistry; atomic, elemental, and molecular movement detectors (hardware and software); atmospheric vital statistic determiners (hardware and software); and additional sensors and detectors as needed.

Figure 6:
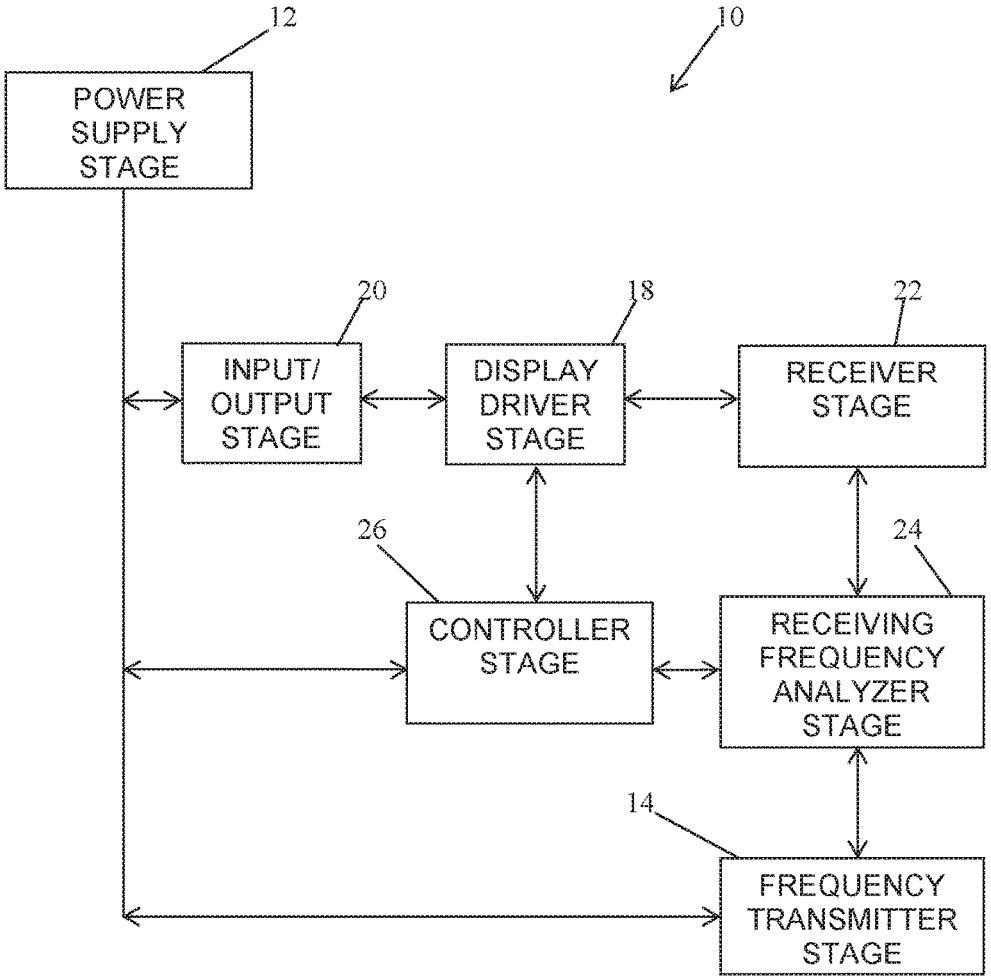
FIG. 6 is a functional block diagram of yet another preferred embodiment of the present invention showing the power supply stage, the electromagnetic wave transmitter stage, the display driver stage, the input/output stage, the receiver stage; the receiving frequency analyzer stage, and a controller stage.

As shown in FIG. 6, a sixth preferred embodiment of the electronic fire extinguisher 10 consists of the same power supply stage 12, frequency transmitter stage 14, on/off mechanism 16 (not shown), display driver stage 18, input/output stage 20, receiver stage 22, and receiving frequency analyzer stage 24, as well as, a controller stage 26. The power supply stage 12, frequency transmitter stage 14, on/off mechanism 16, display driver stage 18, input/output stage 20, receiver stage 22, and receiving frequency analyzer stage 24 are as described above. The controller stage 26 is preferably electrically connected to the other stages 12, 14, 18, 20, 22, 24. FIG. 6 shows the controller stage 26 between the display driver stage 18 and the receiving frequency analyzer stage 24 (or in parallel the power supply stage 12), but the parts may be assembled in any order.

As with the other stages, the controller stage 26 can use, receive, or transfer power, data, communication and control information to or from the power supply stage 12, the frequency transmitter stage 14, the display driver stage 18, the input/output stage 20, the receiver stage 22, and/or the receiving frequency analyzer stage 24. The controller stage 26 is preferably configured to interact with the other stages 12, 14, 18, 20, 22, 24, so it preferably has similar ranges of input voltages and output signals.

The controller stage 26 operates to electronically regulate, condition, or modify the transmission of frequencies, as well as, to control any of the other stages of the electronic fire extinguisher 10. This controller stage 26 may work in conjunction with the receiving frequency analyzer stage 24 and utilize: software; software subroutines; quantum mechanics; nuclear physics; molecular chemistry; atomic, elemental, and molecular movement detectors (hardware and software); atmospheric vital statistic determiners (hardware and software); and additional sensors and detectors as needed.

Figure 7:
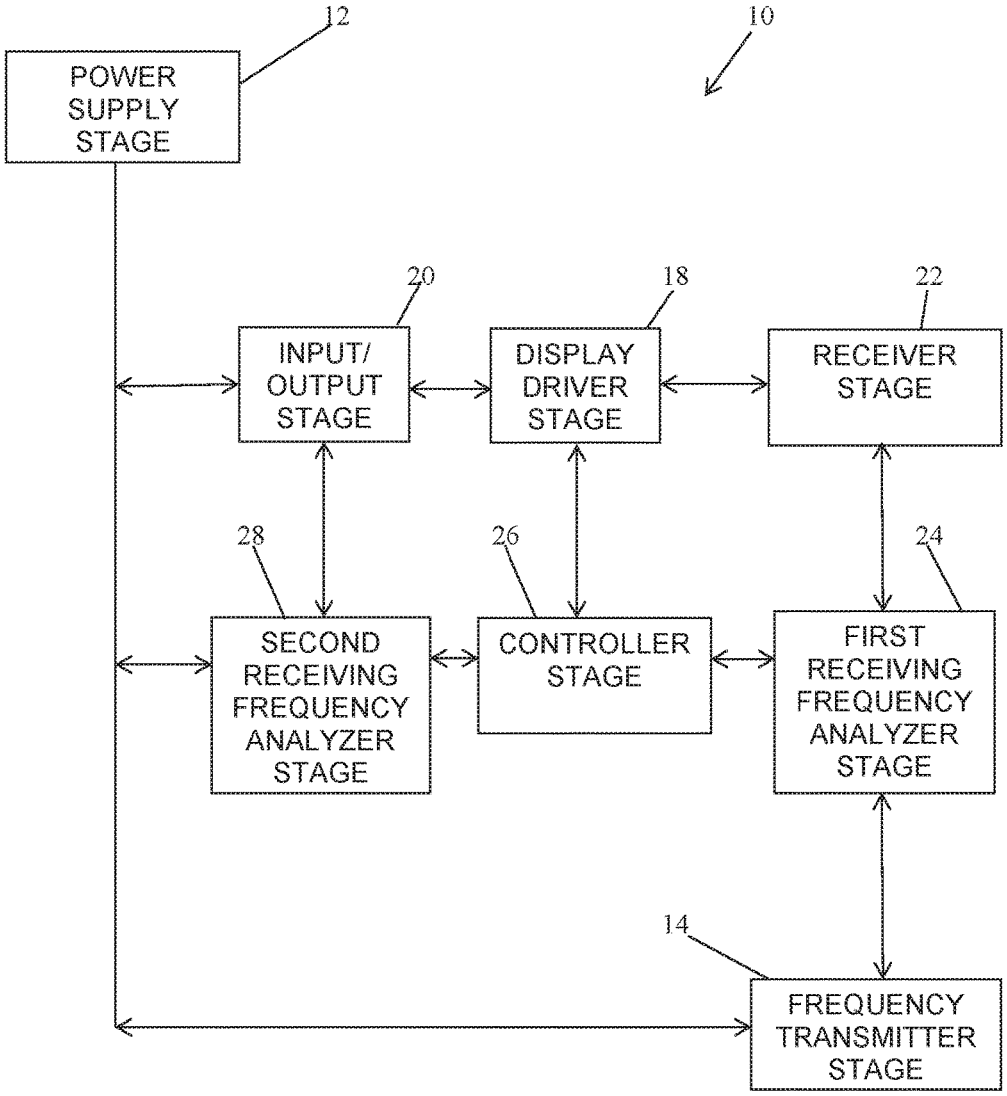
FIG. 7 is a functional block diagram of yet another preferred embodiment of the present invention showing the power supply stage, the electromagnetic wave transmitter stage, the display driver stage, the input/output stage, the receiver stage; the receiving frequency analyzer stage, the controller stage, and a second receiving frequency analyzer stage.

As shown in FIG. 7, a seventh preferred embodiment of the electronic fire extinguisher 10 consists of the same power supply stage 12, frequency transmitter stage 14, on/off mechanism 16 (not shown), display driver stage 18, input/output stage 20, receiver stage 22, receiving frequency analyzer stage 24, and controller stage 26, as well as, a second receiving frequency analyzer stage 28. The power supply stage 12, frequency transmitter stage 14, on/off mechanism 16, display driver stage 18, input/output stage 20, receiver stage 22, receiving frequency analyzer stage 24, and controller stage 26 are as described above. The second receiving frequency analyzer stage 28 is preferably electrically connected to the other stages 12, 14, 18, 20, 22, 24, 26. FIG. 7 shows the second receiving frequency analyzer stage 28 between the input/output stage 20 and the controller stage 26 (or in parallel the power supply stage 12), but the parts may be assembled in any order.

As with the other stages, the second receiving frequency analyzer stage 28 can use, receive, or transfer power, data, communication and control information to or from the power supply stage 12, the frequency transmitter stage 14, the display driver stage 18, the input/output stage 20, the receiver stage 22, the receiving frequency analyzer stage 24, and/or the controller stage 26. The second receiving frequency analyzer stage 28 is preferably configured to interact with the other stages 12, 14, 18, 20, 22, 24, 26, so it preferably has similar ranges of input voltages and output signals.

The second receiving frequency analyzer stage 28 preferably cooperates with the receiver stage 22, the receiving frequency analyzer stage 24, and the controller stage 26 to more effectively electronically regulate, condition, or modify the transmission of frequencies to a fire. The second receiving frequency analyzer stage 28 allows the electronic fire extinguisher 10 to fine tune its emitted frequency wave patterns by determining the cause and effect relationship (the dx difference on the fire) of the different frequencies being transmitted into the fire thereby allowing the electronic fire extinguisher 10 to optimize the transmitting frequencies to obtain a faster and more efficient fire extinguishing process. This second receiving frequency analyzer stage 28 may work in conjunction with the receiving frequency analyzer stage 24 and utilize: software; software subroutines; quantum mechanics; nuclear physics; molecular chemistry; atomic, elemental, and molecular movement detectors (hardware and software); atmospheric vital statistic determiners (hardware and software); and additional sensors and detectors as needed.

Figure 8:
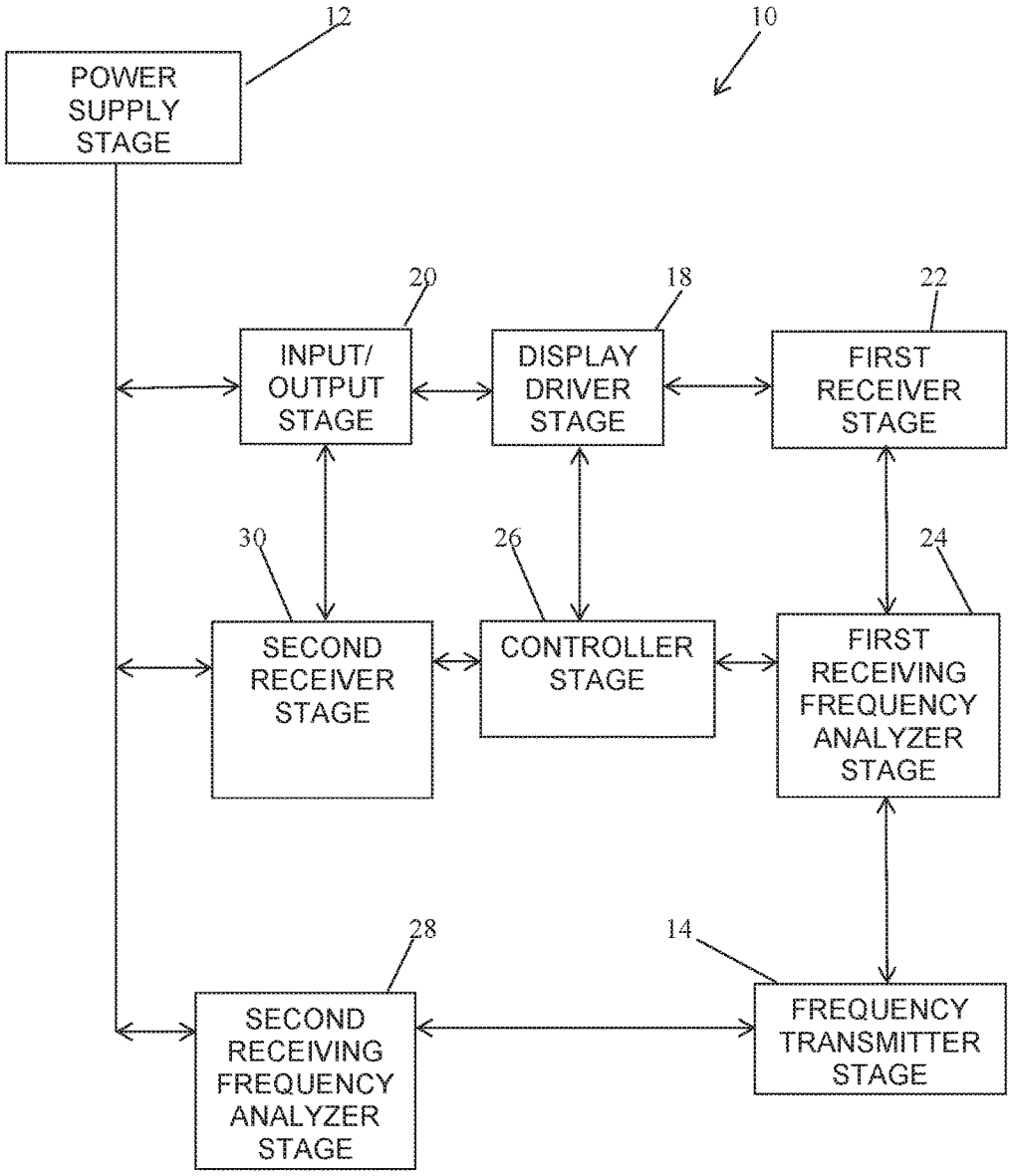
FIG. 8 is a functional block diagram of yet another preferred embodiment of the present invention showing the power supply stage, the electromagnetic wave transmitter stage, the display driver stage, the input/output stage, the receiver stage; the receiving frequency analyzer stage, the controller stage, the second receiving frequency analyzer stage, and a second receiver stage.

As shown in FIG. 8, an eighth preferred embodiment of the electronic fire extinguisher 10 consists of the same power supply stage 12, frequency transmitter stage 14, on/off mechanism 16 (not shown), display driver stage 18, input/output stage 20, receiver stage 22, receiving frequency analyzer stage 24, controller stage 26, and second receiving frequency analyzer stage 28, as well as, a second receiver stage 30. The power supply stage 12, frequency transmitter stage 14, on/off mechanism 16, display driver stage 18, input/output stage 20, receiver stage 22, receiving frequency analyzer stage 24, controller stage 26, and second receiving frequency analyzer stage 28 are as described above. The second receiver stage 30 is preferably electrically connected to the other stages 12, 14, 18, 20, 22, 24, 26, 28. FIG. 8 shows the second receiver stage 30 between the input/output stage 20 and the controller stage 26 (or in parallel the power supply stage 12), but the parts may be assembled in any order.

As with the other stages, the second receiver stage 30 can use, receive, or transfer power, data, communication and control information to or from the power supply stage 12, the frequency transmitter stage 14, the display driver stage 18, the input/output stage 20, the receiver stage 22, the receiving frequency analyzer stage 24, the controller stage 26, and/or the second receiving frequency analyzer stage 28.

The second receiver stage 30 is preferably configured to interact with the other stages 12, 14, 18, 20, 22, 24, 26, 28, so it preferably has similar ranges of input voltages and output signals.

The second receiver stage 30 preferably cooperates with the second receiving frequency analyzer stage 28 and the controller stage 26 so as to work on analyzing a portion of the fire other than the one that is presenting being subjected to electronic frequency waves. The second receiver stage 30 is configured to receive frequencies from the next section of the fire before the electronic fire extinguisher 10 has completed the transmitting and extinguishing process of the section of the fire it is currently working on. In this way, the electronic fire extinguisher can have already determined the proper and most efficient transmitting frequencies to extinguish the fire even faster and more efficiently. The second receiving frequency analyzer stage 28 can then analyze the cause and effects of a particular transmission pattern ahead of time for a quicker fire extinguishing process and completion. Such stage 30 can use of software, software subroutines, fractal and integral calculus, quantum mechanics; nuclear physics; molecular chemistry; atomic, elemental, and molecular movement detectors (hardware and software); atmospheric vital statistic determiners (hardware and software); and additional sensors and detectors as needed.

Figure 9:
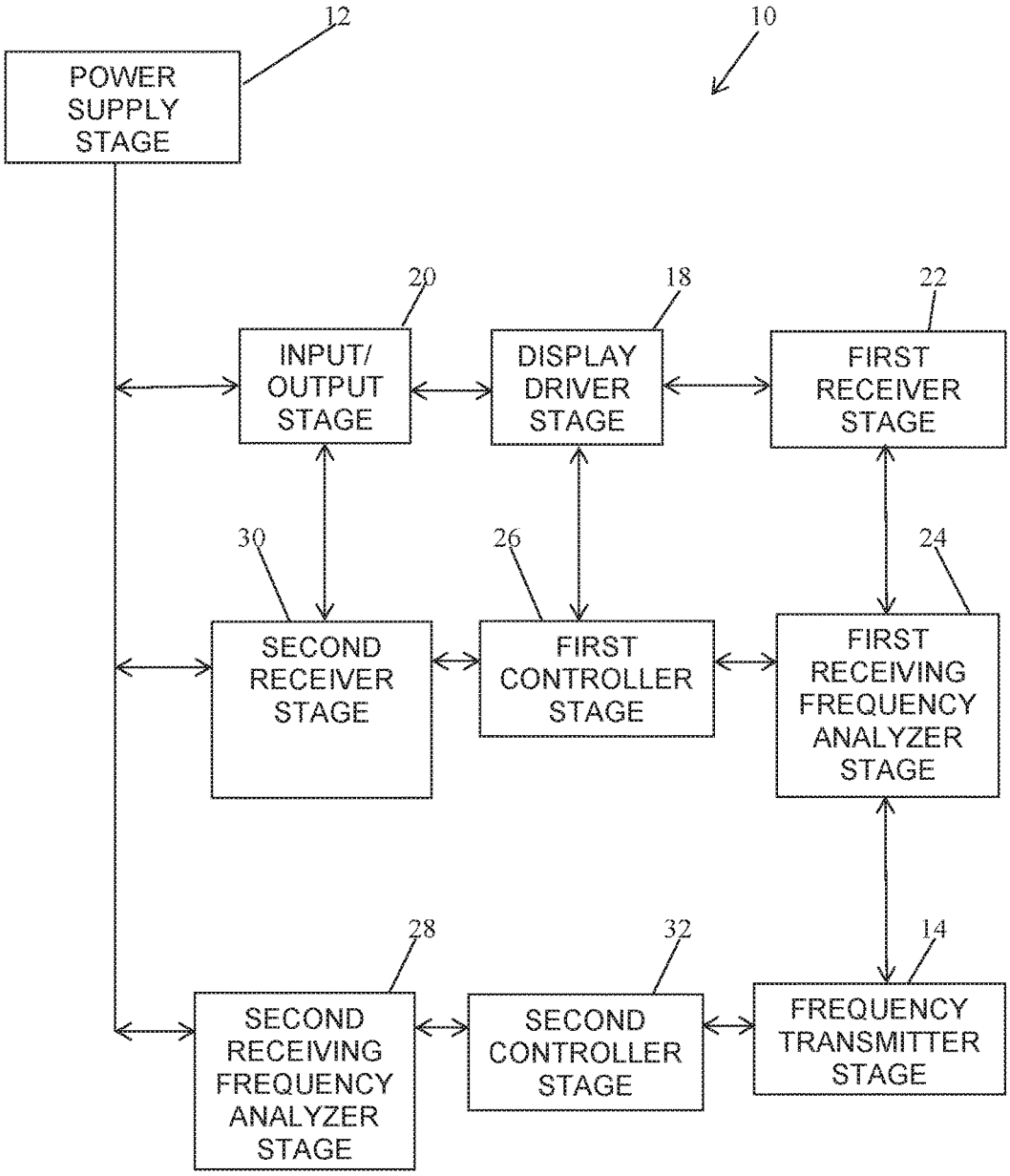
FIG. 9 is a functional block diagram of yet another preferred embodiment of the present invention showing the power supply stage, the electromagnetic wave transmitter stage, the display driver stage, the input/output stage, the receiver stage; the receiving frequency analyzer stage, the controller stage, the second receiving frequency analyzer stage, the second receiver stage, and a second controller stage.

As shown in FIG. 9, a ninth preferred embodiment of the electronic fire extinguisher 10 consists of the same power supply stage 12, frequency transmitter stage 14, on/off mechanism 16 (not shown), display driver stage 18, input/output stage 20, receiver stage 22, receiving frequency analyzer stage 24, controller stage 26, second receiving frequency analyzer stage 28, and second receiver stage 30, as well as, a second controller stage 32. The power supply stage 12, frequency transmitter stage 14, on/off mechanism 16, display driver stage 18, input/output stage 20, receiver stage 22, receiving frequency analyzer stage 24, controller stage 26, second receiving frequency analyzer stage 28, and second receiver stage 30 are as described above. The second controller stage 32 is preferably electrically connected to the other stages 12, 14, 18, 20, 22, 24, 26, 28, 30. FIG. 9 shows the second controller stage 32 between the frequency transmitter stage 14 and the second receiving frequency analyzer stage 28, but the parts may be assembled in any order.

As with the other stages, the second receiver controller stage 32 can use, receive, or transfer power, data, communication and control information to or from the power supply stage 12, the frequency transmitter stage 14, the display driver stage 18, the input/output stage 20, the receiver stage 22, the receiving frequency analyzer stage 24, the controller stage 26, the second receiving frequency analyzer stage 28, and/or the second receiver stage 30. The second controller stage 32 is preferably configured to interact with the other stages 12, 14, 18, 20, 22, 24, 26, 28, 30, so it preferably has similar ranges of input voltages and output signals.

The second controller stage 32 preferably cooperates with the second receiving frequency analyzer stage 28 to regulate, condition, or modify the transmission of frequency pattern, to control any of the stages in the present invention. The second controller stage 32 can include, but is not limited to the use of: software; software subroutines; quantum mechanics; nuclear physics; molecular chemistry; atomic, elemental, and molecular movement detectors (hardware and software); atmosphere vital statistic determiners (hardware and software); and additional sensors and detectors as needed, as well as, the ability to control the individual stages and processes that can be controlled by other stages.

The details of how the various stages in the electronic fire extinguisher 10 are constructed and connected are not critical to the present invention, so long as power is supplied and electronic frequencies are emitted consistent with the frequencies and patterns described herein. A person of ordinary skill in the electronic arts will understand how to construct devices/stages capable of meeting the stated requirements. Such a person will understand and appreciate the existence of variations, combinations, and equivalents of the specific embodiments, methods, and examples herein. The invention should therefore not be limited by the above described embodiment, method, and examples, but by all embodiments and methods within the scope and spirit of the invention. Accordingly, the invention is not to be limited, except as by the appended claims.

What is claimed is:

1. A process for electronically suppressing combustion in a fire, comprising the steps of:

providing an electromagnetic wave transmitter; and directing a frequency wave pattern generated by the electromagnetic wave transmitter into the fire, wherein the frequency wave pattern comprises two or more electromagnetic waves;

wherein each electromagnetic wave in the frequency wave pattern has a frequency in an ordered progression that is either ascending or descending relative to prior electromagnetic waves in the frequency wave pattern; and preventing interaction of combustion components in the fire through the frequency wave pattern.

2. The process of claim 1, wherein each electromagnetic wave in the frequency wave pattern has a frequency in the range of 2.5 Hz-128.0 GHz and a power in the range of 0.1 W to 4.0 W for fires up to 1,000 feet distant and wherein the frequency and power of each electromagnetic wave in the frequency wave pattern have an inverse relationship.

3. The process of claim 1, wherein each electromagnetic wave in the frequency wave pattern has a duration in the range of 0.1 sec-10 sec, except for a final electromagnetic wave in the frequency wave pattern, which has a duration until the fire is extinguished.

4. The process of claim 1, wherein the preventing step comprises the steps of:

creating charged particles or charged fields from the combustion components by the frequency wave pattern; and repelling the combustion components through interaction with the charged particles or charged fields.

5. The process of claim 1, wherein each electromagnetic wave in the frequency wave pattern initiates a harmonic resonance with combustion components in the fire and the frequency wave pattern alters an operating frequency of the fire so as to establish a Natural Harmonic Frequency with the combustion components in the fire.

6. The process of claim 1, wherein the frequency wave pattern comprises:

a first electromagnetic wave having a frequency of 3.573 Hz at a power of 2.98 W and a duration of 2.83 sec;

a second electromagnetic wave having a frequency of 17.632 Hz at a power of 2.75 W and a duration of 3.89 sec; and a third electromagnetic wave having a frequency of 45.895 Hz at a power of 2.57 W and a continuous duration until the fire is extinguished.

7. The process of claim 1, wherein the frequency wave pattern comprises:

a first electromagnetic wave having a frequency of 4.689 Hz at a power of 2.89 W and a duration of 4.13 sec;

a second electromagnetic wave having a frequency of 9.367 Hz at a power of 2.74 W and a duration of 5.12 sec; and a third electromagnetic wave having a frequency of 301.482 Hz at a power of 2.25 W and a continuous duration until the fire is extinguished.

8. The process of claim 1, wherein the frequency wave pattern comprises:

a first electromagnetic wave having a frequency of 104.794 KHz at a power of 2.77 W and a duration of 4.92 sec;

a second electromagnetic wave having a frequency of 542.296 MHz at a power of 2.49 W and a duration of 5.79 sec; and a third electromagnetic wave having a frequency of 66.312 GHz at a power of 1.69 W and a continuous duration until the fire is extinguished.

9. The process of claim 1, wherein the frequency wave pattern comprises:

a first electromagnetic wave having a frequency of 5.135 Hz at a power of 2.99 W and a duration of 1.74 sec;

a second electromagnetic wave having a frequency of 22.135 KHz at a power of 2.59 W and a duration of 2.69 sec;

a third electromagnetic wave having a frequency of 29.513 MHz at a power of 2.29 W and a duration of 6.67 sec; and a fourth electromagnetic wave having a frequency of 243.543 MHz at a power of 2.11 W and a continuous duration until the fire is extinguished.

10. The process of claim 1, wherein the frequency wave pattern comprises:

a first electromagnetic wave having a frequency of 17.374 Hz at a power of 2.94 W and a duration of 3.93 sec;

a second electromagnetic wave having a frequency of 2.831 KHz at a power of 2.95 W and a duration of 4.91 sec;

a third electromagnetic wave having a frequency of 14.821 GHz at a power of 1.53 W and a duration of 5.31 sec; and a fourth electromagnetic wave having a frequency of 127.341 GHz at a power of 0.70 W and a continuous duration until the fire is extinguished.

11. The process of claim 1, wherein the frequency wave pattern comprises:

a first electromagnetic wave having a frequency of 9.049 Hz at a power of 2.95 W and a duration of 3.46 sec;

a second electromagnetic wave having a frequency of 1.637 MHz at a power of 2.17 W and a duration of 4.39 sec;

a third electromagnetic wave having a frequency of 2.719 GHz at a power of 1.93 W and a duration of 4.89 sec;

a fourth electromagnetic wave having a frequency of 26.198 GHz at a power of 1.17 W and a duration of 5.56 sec; and a fifth electromagnetic wave having a frequency of 61.914 GHz at a power of 0.63 W and a continuous duration until the fire is extinguished.

12. The process of claim 1, wherein the frequency wave pattern comprises:

a first electromagnetic wave having a frequency of 259.726 KHz at a power of 2.91 W and a duration of 5.13 sec;

a second electromagnetic wave having a frequency of 803.673 KHz at a power of 2.71 W and a duration of 5.29 sec;

a third electromagnetic wave having a frequency of 26.486 MHz at a power of 1.97 W and a duration of 5.62 sec;

a fourth electromagnetic wave having a frequency of 1.851 GHz at a power of 1.38 W and a duration of 6.84 sec; and a fifth electromagnetic wave having a frequency of 29.936 GHz at a power of 0.95 W and a continuous duration until the fire is extinguished.

13. An electronic fire suppression device, comprising:

a power supply configured to have a voltage output between 3V-1000V alternating or direct current, and a current output between 100 mAh-1 kAh; and an electromagnetic wave transmitter electrically connected to the power supply and configured to generate a frequency wave pattern of two or more electromagnetic waves;

wherein each electromagnetic wave in the frequency wave pattern has a frequency in an ordered progression that is either ascending or descending relative to prior electromagnetic waves in the frequency wave pattern.

14. The electronic fire suppression device of claim 13, further comprising:

an electromagnetic wave receiver electrically connected to the power supply and configured to detect an operating frequency of combustion components in a target portion of a fire; and a receiving frequency analyzer electrically connected to the electromagnetic wave receiver and the electromagnetic wave transmitter, wherein the receiving frequency analyzer is configured to analyze the operating frequency of combustion components in the target portion of the fire and cause the frequency wave pattern generated by the electromagnetic wave transmitter to establish a Natural Harmonic Frequency with the combustion components in the fire.

15. The electronic fire suppression device of claim 14, further comprising a controller electrically connected to the electromagnetic wave transmitter and the receiving frequency analyzer, wherein the controller is configured to regulate the generation of the frequency wave pattern, including the frequency, power and duration of each of the two or more electromagnetic waves.

16. The electronic fire suppression device of claim 15, further comprising a second receiving frequency analyzer, wherein the second receiving frequency analyzer is configured to analyze the effect of the frequency wave pattern on the combustion components in the fire so as to optimize the Natural Harmonic Frequency with the combustion components.

17. The electronic fire suppression device of claim 16, further comprising a second electromagnetic wave receiver, wherein the second electromagnetic wave receiver is configured to detect the operating frequency of combustion components in a second portion of the fire.

18. The electronic fire suppression device of claim 17, further comprising a second controller electrically connected to the electromagnetic wave transmitter and the second receiving frequency analyzer, wherein the second controller is configured to program the electromagnetic wave transmitter to generate a second frequency wave pattern, including the frequency, power and duration of each electromagnetic wave when the fire suppression device is pointed at the target portion of the fire.

19. A process for electronically suppressing combustion in a fire, comprising the steps of:

providing an electromagnetic wave transmitter;

directing a frequency wave pattern generated by the electromagnetic wave transmitter into the fire, wherein the frequency wave pattern comprises two or more electromagnetic waves;

wherein the frequency wave pattern comprises a first electromagnetic wave having a frequency of 3.573 Hz, a second electromagnetic wave having a frequency of 17.632 Hz, and a third electromagnetic wave having a frequency of 45.895 Hz; and preventing interaction of combustion components in the fire through the frequency wave pattern.

* * * * *